US005117624A

United States Patent [19]

Roberts, Jr. et al.

[11] Patent Number: 5,117,624

[45] Date of Patent: Jun. 2, 1992

[54] FUEL INJECTOR NOZZLE SUPPORT

[75] Inventors: Hubert S. Roberts, Jr.; Mark M. Glevicky, both of Cincinnati, Ohio

[73] Assignee: General Electric Company, Cincinnati, Ohio

[21] Appl. No.: 583,909

[22] Filed: Sep. 17, 1990

[51] Int. Cl.[5] ..... F02C 7/00

[52] U.S. Cl. ..... 60/39.32; 60/740

[58] Field of Search ..... 60/740, 39.31, 39.32, 60/748, 737, 752, 756; 431/350, 351

[56] References Cited

U.S. PATENT DOCUMENTS

| | | | |
|---|---|---|---|
| 3,273,343 | 9/1966 | Cretella . | |
| 3,385,055 | 5/1968 | Koblish et al. | 60/748 |
| 3,720,058 | 3/1973 | Collinson et al. . | |
| 4,441,323 | 4/1984 | Colley | 60/737 |
| 4,454,711 | 6/1984 | Ben-Porat | 60/39.32 |
| 4,498,288 | 2/1985 | Vogt . | |
| 4,584,834 | 4/1986 | Koshoffer et al. | 60/737 |
| 4,653,278 | 3/1987 | Vinson et al. | 60/737 |
| 4,689,961 | 9/1987 | Stratton . | |
| 4,763,482 | 8/1988 | Wehner . | |

*Primary Examiner*—Richard A. Bertsch

*Assistant Examiner*—Timothy S. Thorpe

*Attorney, Agent, or Firm*—Jerome C. Squillaro; James P. Davidson

[57] ABSTRACT

A fuel injector nozzle support includes a support plate joinable to a combustor dome and a ferrule slidably joined to the support plate. The ferrule includes a base, and a bore for slidably receiving a fuel injector nozzle. The ferrule base has a noncircular perimeter and the support plate includes a receptacle for receiving the ferrule base which has an inner circumference being complementary to the ferrule base perimeter for preventing rotation of the ferrule base greater than a predetermined maximum rotation while allowing radial translation of the ferrule base for accommodating differential radial thermal movement of the fuel injector nozzle and the support plate. In an exemplary embodiment, the base perimeter and the receptacle have complementary straight and arcuate profiles, and the support plate is formed with counterrotational swirler vanes of a swirler fixedly supported to a combustor dome. The noncircular perimeter assembly eliminates the use of conventional antirotational lugs and stops.

18 Claims, 5 Drawing Sheets

FUEL INJECTOR NOZZLE SUPPORT

TECHNICAL FIELD

The present invention relates generally to gas turbine engine combustors, and, more specifically, to a support for mounting a fuel injector nozzle to a dome of the combustor.

BACKGROUND ART

Gas turbine engine combustors, such as those used in engines for powering aircraft, typically include coannular outer and inner combustor liners joined at their upstream ends by an annular dome for defining therein an annular combustion dome. The dome includes a plurality of circumferentially spaced carburetors for providing a fuel/air mixture into the combustor which is conventionally ignited for generating combustion gases.

Each of the carburetors includes a typical air swirler, such as a counterrotational swirler, and a fuel injector nozzle slidably supported therein. Pressurized air is channeled to the swirlers from a conventional compressor positioned upstream of the combustor and is precisely metered through the swirler and mixed therein with fuel from the nozzle for obtaining precise fuel/air ratios for efficient combustion.

The combustion gases generated in the combustor heat the combustor liners, the combustor dome, and the swirlers which results in thermal expansion thereof. Since the combustor is annular about a longitudinal centerline of the gas turbine engine, the combustor, including the dome, expands radially outwardly to an increased diameter when so heated. The combustor also expands longitudinally, or axially, and increases in length upon being heated.

On the other hand, the fuel injector nozzles typically extend from a fuel injector stem supported from a stationary outer casing. The fuel channeled through the stem and nozzles is relatively cool, and therefore, during operation of the combustor, the combustor expands at a greater rate than that of the fuel stem supporting the nozzle. Accordingly, differential movement, both radially and axially between the fuel injector nozzles and the swirlers must be accommodated for preventing undesirable stress therein while obtaining the required precise mixing of fuel and air. Similarly, as the temperature of the combustor decreases, the combustor contracts and the differential movement between the combustor and the fuel injector nozzles must also be accommodated.

One conventional means for accommodating the differential thermal movement between the fuel injector nozzles and the swirlers joined to the combustor dome includes a free floating ferrule slidably joined to the swirler for slidably receiving a respective fuel injector nozzle. More specifically, the ferrule includes a central bore disposed coaxially with the fuel nozzle for receiving and supporting the fuel nozzle in axial sliding engagement therewith. The ferrule also includes a radially extending circular flange which is conventionally slidably captured in the swirler which allows the ferrule to move radially relative to the swirler. Accordingly, upon differential thermal movement between the fuel nozzle and the swirler joined to the dome, the nozzle is free to slide in the ferrule bore axially, and is also free to translate radially with the ferrule which is free to translate radially relative to the swirler.

However, since the ferrule is free floating and therefore is allowed to translate both radially and circumferentially within predetermined limits relative to the swirler, it is subject to aerodynamic and vibratory forces during operation of the gas turbine engine and combustor. For example, the compressed airflow from the compressor is provided at a relatively high pressure compared to the combustion gases within the combustor and acts against the ferrule. Furthermore, since the gas turbine engine includes various rotating components, including the compressor rotor, vibratory excitation forces are generated which act upon the ferrule.

Accordingly, the ferrule will vibrate and rotate relative to the fuel nozzle during operation. This motion is typically undesirable since it will cause wear between the ferrule and the fuel nozzle and swirler which decreases the effective life of those components. Accordingly, the ferrule is typically provided with a radially extending tab or lug which is positioned against a complementary radially extending stop joined to the swirler so that the lug contacts the stop for preventing rotation of the ferrule during operation.

The contact area between the lugs and respective stops is relatively small and they too are then subject to wear during operation. The wear between the lugs and the stops therefore affects the useful life of the ferrule and swirler since these components must be replaced at periodic intervals in order to prevent undesirable wear thereof which might possibly liberate a lug or stop during operation which would then be carried downstream in the engine possibly causing additional damage thereto.

Furthermore, the provision of lugs and stops results in a more complex and expensive ferrule-swirler arrangement, which is compounded by the fact that a substantial number of fuel nozzles and swirlers are used in a typical combustor around the circumference of the dome. Yet further, in more advanced gas turbine engines, double dome configurations are being considered wherein two concentric outer and inner domes include respective pluralities of carburetors, thereby increasing, yet further, the number of ferrules and corresponding lugs and stops which are required.

OBJECTS OF THE INVENTION

Accordingly, one object of the present invention is to provide a new and improved fuel injector nozzle support.

Another object of the present invention is to provide a fuel injector nozzle support having relatively simple means for restraining circumferential rotation of a nozzle support ferrule.

Another object of the present invention is to provide a fuel injector nozzle support which does not require projecting lugs and complementary stops for restraining rotation thereof.

Another object of the present invention is to provide a fuel injector nozzle support which eliminates the potential of foreign object damage from the liberation of antirotational lugs and stops.

DISCLOSURE OF INVENTION

A fuel injector nozzle support includes a support plate joinable to a combustor dome, and a ferrule slidably joined to the support plate. The ferrule includes a base, and a bore for slidably receiving a fuel injector nozzle. The ferrule base has a noncircular perimeter and the support plate includes a receptacle for receiving the ferrule base which has an inner circumference being complementary to the ferrule base perimeter for preventing rotation of the ferrule base greater than a predetermined maximum rotation while allowing radial translation of the ferrule base for accommodating differential thermal movement of the fuel injector nozzle and the support plate. In an exemplary embodiment, the support plate is formed with counterrotational swirler vanes of a swirler fixedly supported to a combustor dome.

BRIEF DESCRIPTION OF THE DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

MODE(S) FOR CARRYING OUT THE INVENTION

Figure 1:
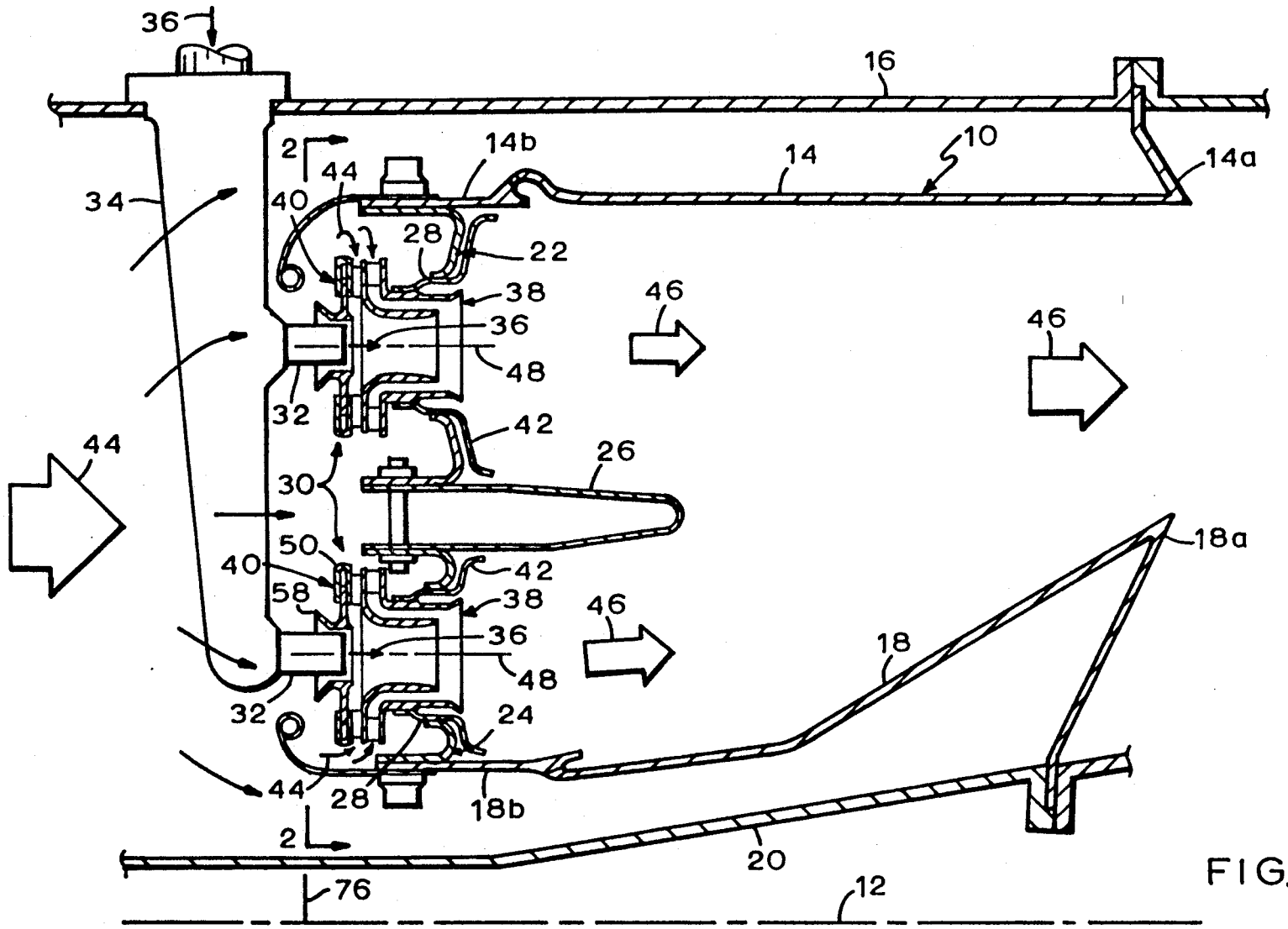
FIG. 1 is a longitudinal sectional view of a double dome combustor including fuel injector nozzle supports in accordance with one embodiment of the present invention.

Illustrated in FIG. 1 is an exemplary annular double dome combustor 10 disposed coaxially about a longitudinal, or axial centerline axis 12 of a gas turbine engine. Although a double dome combustor is illustrated, the invention may be practiced with conventional single dome combustors as well. The combustor 10 includes a conventional annular outer liner 14, shown schematically, having an aft end **14*a* which is conventionally fixedly supported to an annular outer casing 16 of the engine, and an annular inner liner 18, also shown schematically, spaced radially inwardly from the outer liner 14 and having an aft end 18*a* conventionally fixedly supported to an annular inner casing 20** of the engine.

The outer liner 14 also includes a forward end **14*b* which is conventionally fixedly connected to a conventional annular, radially outer first dome 22, by bolts having mating nuts, for example. The inner liner 18 also includes a forward end 18*b* conventionally fixedly joined to an annular, radially inner second dome 24, by conventional bolts, for example. A conventional annular hollow centerbody 26 is conventionally fixedly joined to the radially inner circumference of the first dome 22 and the radially outer circumference of the second dome 24 by bolts, for example. The first dome 22, second dome 24, and centerbody 26 are all disposed coaxially about the centerline axis 12**.

The first and second domes 22 and 24 each includes a plurality of circumferentially spaced dome inlets 28 for supporting therein respective pluralities of carburetors 30. The carburetors 30 and the first and second domes 22 and 24, in this embodiment of the invention, are identical except for preferred sizing thereof, and therefore, the description of one of the carburetors 30 applies to all of the carburetors 30 in both of the first and second domes 22 and 24.

Each of the carburetors 30 includes a conventional fuel injector nozzle 32 extending from a conventional fuel stem 34. The fuel stem 34 is conventionally supported and extends radially inwardly from the casing 16 and is conventionally provided with fuel 36 which is discharged from the nozzles 32 through the dome inlets 28. Each of the carburetors 30 also includes a counterrotational swirler 38 which is conventional except for a fuel injector nozzle support 40 in accordance with one embodiment of the present invention. In this exemplary embodiment, each of the swirlers 38 is conventionally fixedly connected, by brazing for example, to a conventional annular baffle 42, which baffle 42 is also conventionally fixedly supported, by brazing for example, to respective domes 22 and 24 through respective dome inlets 28.

Pressurized, compressed airflow 44 is conventionally channeled to the combustor 10 from a conventional compressor disposed upstream therefrom (not shown) for conventionally cooling the combustor 10 as well as providing airflow for combustion. For example, the compressed airflow 44 is conventionally channeled through the swirlers 38 and is mixed therein with the fuel 36 from the nozzles 32 for forming a predetermined fuel/air mixture which flows downstream from the first and second domes 22 and 24 and is conventionally ignited for generating combustion gases 46 which are discharged from the combustor 10 to a conventional turbine (not shown) which drives the compressor.

During operation of the combustor 10, the combustion gases 46 heat the outer and inner liners 14 and 18 and the domes 22 and 24, thusly causing them to heat and expand both radially outwardly from the engine centerline axis 12, and axially upstream from the downstream ends **14*a* and 18*a* of the liners. The fuel stem 34 is relatively cooler than the combustor 10 since relatively cool fuel 36 is channeled therethrough, and therefore, differential thermal movement, both radially and axially, between the fuel stem 34 and the combustor 10 occurs. Accordingly, the fuel injector nozzle supports 40 in accordance with one embodiment of the present invention are provided for supporting the nozzles 32 to the domes 22 and 24** while allowing axial and radial movements therebetween for preventing undesirable thermal stresses which would otherwise be generated if these components were fixedly connected to each other.

Figure 2:
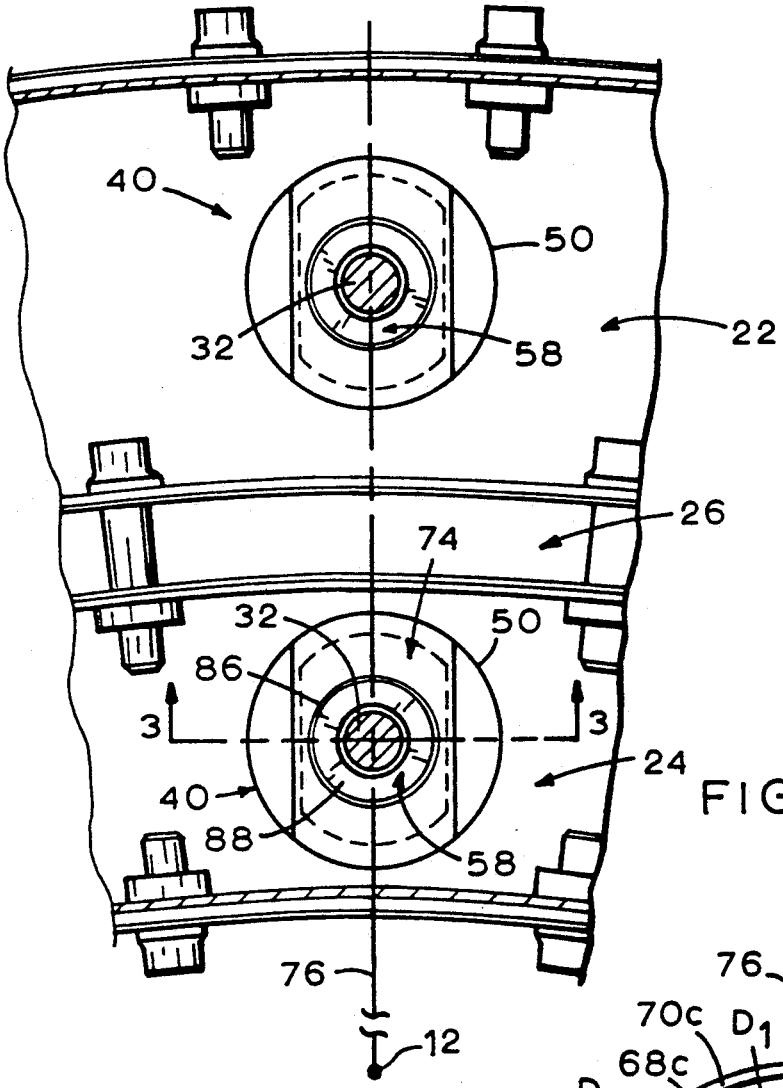
FIG. 2 is an aft facing transverse view, partly sectional view, of a portion of the combustor dome illustrated in FIG. 1 taken along line 2—2 showing a pair of radially aligned counterrotational swirlers including the fuel injector nozzle support in accordance with a preferred embodiment.
Figure 3:
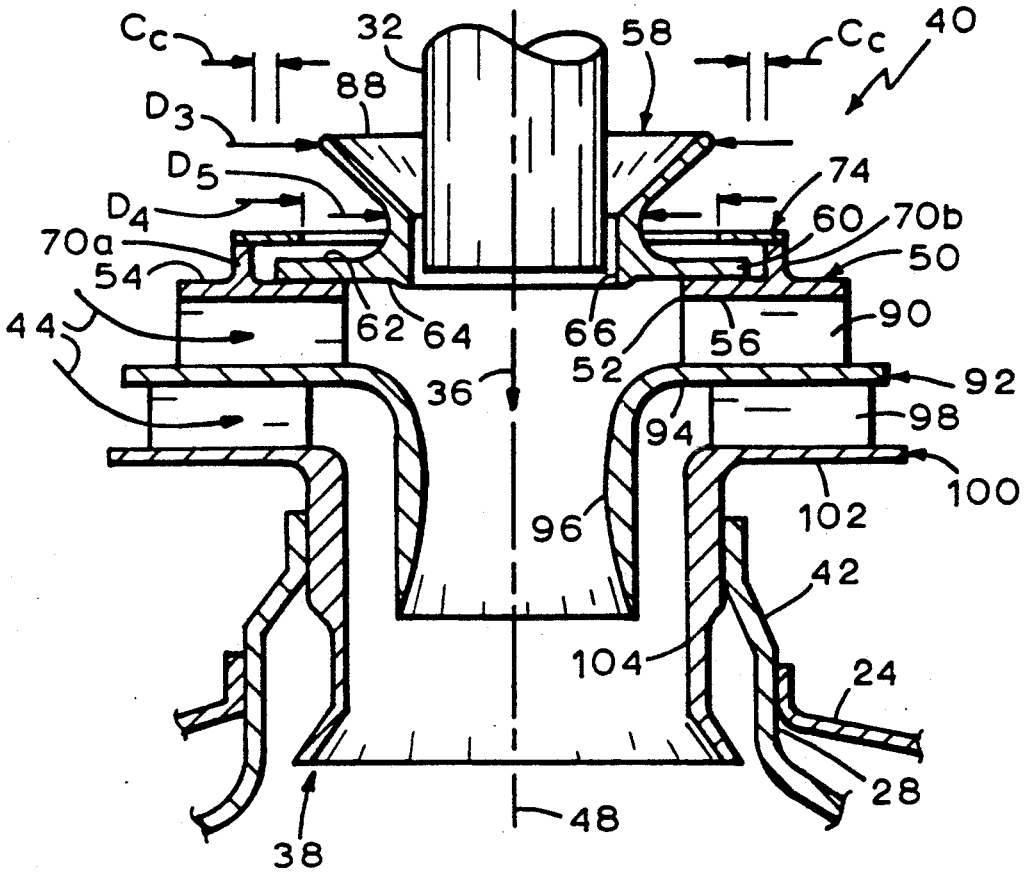
FIG. 3 is a radial sectional view of one of the identical carburetors illustrated in FIG. 2 taken along line 3—3 including the fuel injector nozzle support in accordance with the preferred embodiment.
Figure 4:
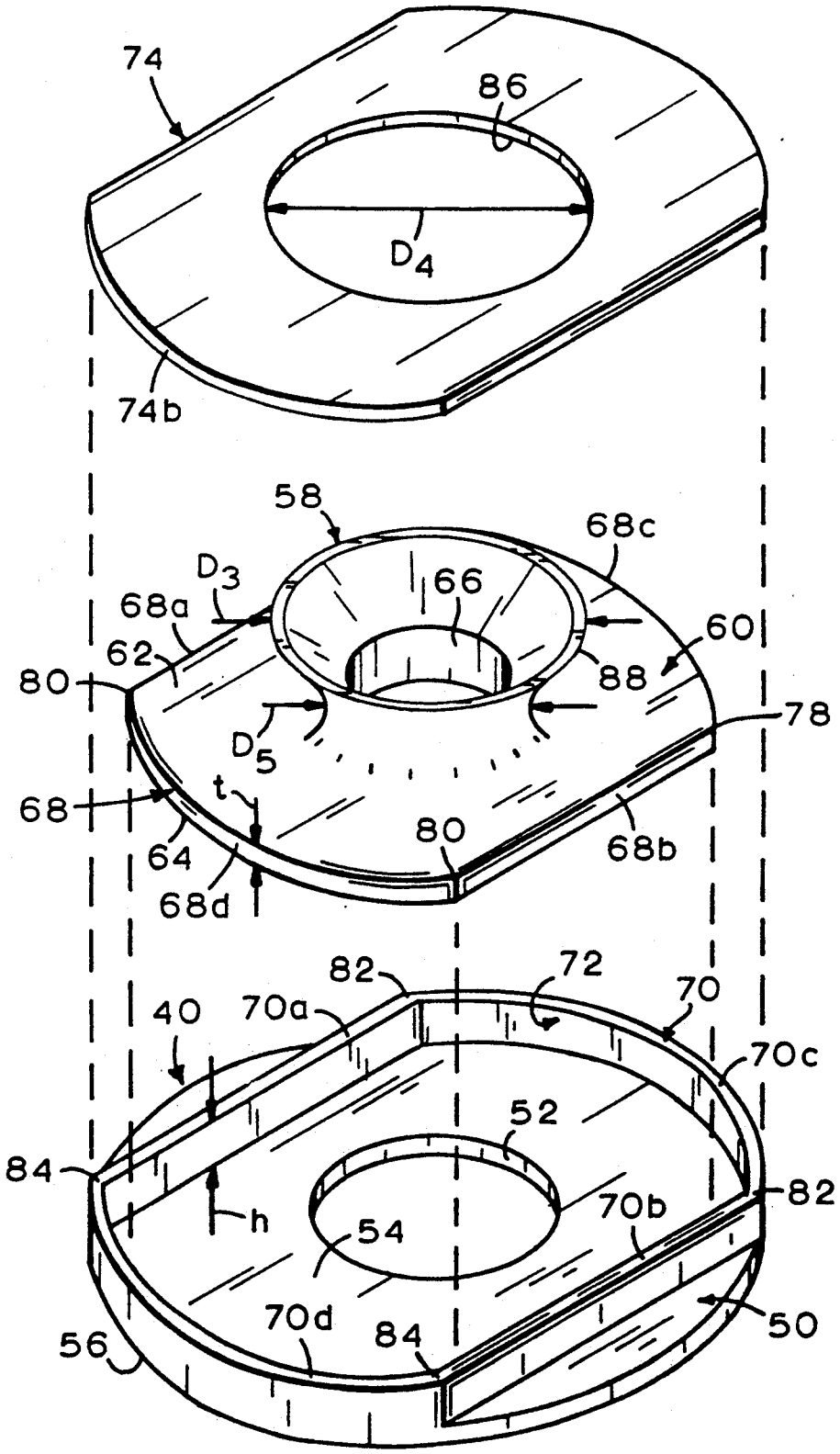
FIG. 4 is a perspective, exploded view of the fuel injector nozzle support illustrated in FIGS. 1-3 in accordance with the preferred embodiment.

Illustrated in FIGS. 2–4 is the fuel injector nozzle support 40 in accordance with a preferred and exemplary embodiment of the present invention as applied to the second dome 24 illustrated in FIG. 1. The support 40 for the first dome 22 is identical, except for size, and therefore will not be described separately. The swirler 38 and the baffle 42 are conventionally disposed coaxially about an axial, or longitudinal, centerline axis 48 of the dome inlet 28 as shown for example in FIG. 3.

The nozzle support 40 includes a support plate 50 fixedly joined to the dome 24 as described in more detail hereinbelow, and includes a central plate aperture 52 which is disposed coaxially about the centerline axis 48 in flow communication with the dome inlet 28. The plate 50 also includes a forward surface 54 facing in the upstream direction, and an opposite, aft surface 56 facing in the downstream direction. The nozzle support 40 also includes a ferrule 58 having a base 60 which includes an upstream facing forward surface 62 and a downstream facing aft surface 64. The base 60 includes a central ferrule bore 66 for axially slidably receiving the fuel injector nozzle 32. The inner diameter of the bore 66 is conventionally slightly larger than the outer diameter of the nozzle 32 to allow for a sliding fit and to accommodate for manufacturing tolerances and expected differential thermal expansion therebetween. The bore 66 is disposed generally coaxially about the centerline axis 48 in flow communication with the plate aperture 52 and the dome inlet 28 for allowing the fuel 36 from the nozzle 32 to be injected through the dome inlet 28 into the combustor 10.

Figure 5:
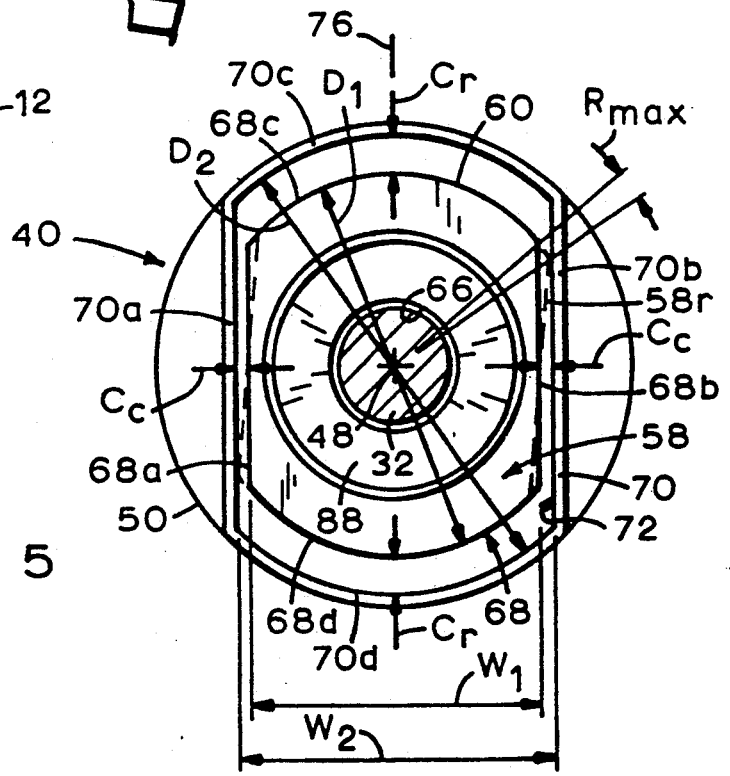
FIG. 5 is an enlarged aft facing view of a portion of one of the identical fuel injector nozzle supports illustrated in FIG. 2.

As illustrated in more particularity in FIGS. 4 and 5, the ferrule base 60 in accordance with the present invention has a noncircular perimeter 68 which is characterized by the absence of projecting tabs or lugs as found in the prior art for restraining rotation thereof, and the support plate 50 includes a receptacle 70 for receiving the ferrule base 60. The receptacle 70 has an inner circumference 72 which is preferably complementary in configuration to the ferrule base perimeter 68 for restraining or preventing rotation of the ferrule base 60 relative to the centerline axis 48 greater than a predetermined maximum rotation $R_{max}$ while allowing radial translation of the ferrule base 60 up to a predetermined maximum translation relative to the engine centerline axis 12, and the dome inlet centerline axis 48, for accommodating differential thermal movement between the fuel injector nozzle 32 and the support plate 50. The fuel injector nozzle support 40 also includes means in the form of a retention plate 74 for axially retaining the ferrule 58 in the support plate receptacle 70 relative to the centerline axis 48.

Referring again to FIGS. 4 and 5, the noncircular ferrule base perimeter 68 is illustrated in more particularity. In the preferred embodiment, the perimeter 68 is quadrilateral having straight first and second spaced apart edges **68*a* and 68*b*, respectively, disposed parallel to each other and generally parallel to a radial axis 76 extending perpendicularly outwardly from the engine centerline axis 12. The support plate 50 includes preferably straight first and second spaced apart flanges 70*a* and 70*b*, respectively, which extend perpendicularly outwardly from the forward surface 54 of the plate 50 and are disposed parallel to each other to define the receptacle 70. The first and second flanges 70*a* and 70*b* are predeterminedly spaced from the perimeter first and second edges 68*a* and 68*b*, respectively, as shown in FIG. 5 to define circumferential clearances $C_c$. In the preferred embodiment, the base 60 has a width $W_1$ measured between the first and second edges 68*a* and 68*b* which is predeterminedly smaller than a width $W_2$ of the receptacle 70 measured between the first and second flanges 70*a* and 70*b*. This provides for generally equal circumferential clearances $C_c$ between the first edge 68*a* and the first flange 70*a*, and between the second edge 68*b* and the second flange 70*b*. These circumferential clearances $C_c$ are about 70 mils (0.178 cm) for accommodating manufacturing stackup tolerances, and which, therefore allows for rotation of the ferrule 58 up to the maximum rotation $R_{max}$ of about 2.7°. As shown in dashed line indicated 58*r* the ferrule 58** can rotate clockwise up to the maximum rotation angle $R_{max}$, and similarly it can rotate counterclockwise up to the same maximum rotation angle $R_{max}$ (i.e. plus or minus $R_{max}$).

Accordingly, the first and second edges **68*a* and 68*b* disposed in the receptacle 70 against the first and second flanges 70*a* and 70*b* restrain rotation of the ferrule 58 about the axis 48 relative to the stationary support plate 50 without the need for conventional extending lugs and corresponding stops. By utilizing the entire ferrule base 60 in the receptacle 70 for restraining rotation, a considerable amount of wear between these two components may be experienced while still acceptably restraining rotation of the ferrule 58** during its useful life.

Furthermore, the straight edges **68*a* and 68*b* and straight flanges 70*a* and 70*b* are preferred for allowing radial translation movement of the ferrule 58 in the receptacle 70 for accommodating differential radial thermal movement between the fuel injector nozzle 32 disposed in the ferrule bore 66, and the stationary support plate 50 and dome 24. As the nozzle 32 lags radial thermal movement of the dome 24 during operation, the ferrule 58 which is resting on the nozzle 32 remains with the nozzle 32 while the support plate 50 moves radially with the dome 24. By providing the circumferential clearances $C_c$ and the straight edges and flanges 68*a*, 68*b*, 70*a*, and 70*b*, this differential radial thermal movement is accommodated without imposing bending loads on the fuel nozzle 32 and the dome 24**.

Referring again to both FIGS. 4 and 5, the ferrule base perimeter 68 preferably further includes an arcuate third edge **68*c* joining first, radially outer ends 78 of the first and second edges 68*a* and 68*b*, and an arcuate fourth edge 68*d* joining second, opposite, radially inner ends 80 of the first and second edges 68*a* and 68*b***.

Complementarily, the support plate 50 preferably further includes an arcuate third flange **70*c* integrally joining radially outer first ends 82 of the first and second flanges 70*a* and 70*b*, and an arcuate fourth flange 70*d* integrally joining second, opposite, radially inner ends 84 of the first and second flanges 70*a* and 70*b*. The third and fourth flanges 70*c* and 70*d* also extend perpendicularly outwardly from the plate forward surface 54, and the first, second, third, and fourth flanges 70*a*, 70*b*, 70*c*, and 70*d* define collectively the receptacle 70**.

Both the third and fourth edges **68*c* and 68*d* and the third and fourth flanges 70*c* and 70*d* comprise portions of respective circles having respective outer diameter $D_1$ and inner diameter $D_2$. The inner diameter $D_2$ is predeterminedly greater than the outer diameter $D_1$ so that the third and fourth edges 68*c* and 68*d* are spaced radially inwardly from the third flange 70*c* and the fourth flange 70*d*, respectively, to define generally equal radial clearances $C_r$. The radial clearances $C_r$ are generally equal in the preferred embodiment, but may be different depending on particular designs, but in all cases the radial clearances $C_r$ allow for differential radial thermal movement between the ferrule 58 joined to the fuel injector nozzle 32 and the stationary support plate 50 joined to the dome 24. The radial clearance $C_r$ is also referred to as the predetermined maximum translation of the ferrule 58 in the radial direction relative to the engine centerline axis 12 and relative to the support plate 50. The ferrule 58** may move radially outwardly or radially inwardly up to a maximum translation of $C_r$ (i.e. plus or minus $C_r$).

In alternate embodiments of the invention, the third and fourth flanges 70*c* and 70*d* may be eliminated, and therefore only the first and second flanges 70*a* and 70*b* define the receptacle 70 which is, therefore, open at its radially outer and inner ends. However, the third and fourth flanges 70*c* and 70*d* are preferred for limiting the radial travel of the ferrule 58 for better aligning the ferrule 58 with the nozzle 32 for assembly purposes. Furthermore, they are also preferred so that the retaining plate 74 may be fixedly attached to the support plate 50 over 360° for reducing vibratory response.

As illustrated in FIGS. 2 and 4, for example, the retention plate 74 is fixedly joined to the support plate at the first, second, third, and fourth flanges 70*a*, 70*b*, 70*c*, and 70*d*, by being welded or brazed thereto. In the preferred embodiment, the outer perimeter 74*b* of the retaining plate 74 is complementary in configuration to the profiles of the first, second, third, and fourth flanges 70*a*, 70*b*, 70*c*, and 70*d*. The retaining plate 74 includes a central clearance hole 86 for receiving the nozzle 32 and allowing unrestrained or unobstructed axial and transverse, both radial and circumferential, translation of the nozzle 32.

More specifically, in the preferred embodiment, the ferrule 58 includes a conventional conical pilot, or flare, 88 extending outwardly from the forward surface 62 for guiding the nozzle 32 into the ferrule bore 66 during assembly. During assembly, the ferrule 58 as illustrated in FIG. 4 is firstly positioned into the receptacle 70 so that its aft surface 64 contacts the forward surface 54 of the support plate 50. The retaining plate 74 is then positioned over the furrule 58 with the clearance hole 86 being disposed over the pilot 88. The pilot 88 has a maximum outer diameter $D_3$ which is predeterminedly less than an inner diameter $D_4$ of the clearance hole 86. The height h of the flanges 70*a*, 70*b*, 70*c*, and 70*d* is predeterminedly greater than the thickness t of the ferrule base 60 for providing a relatively small clearance of about 15 mils 0.038 cm) for allowing the ferrule 58 to slide in the receptacle 70. The pilot 88 has a minimum diameter $D_5$ which is predeterminedly smaller than the diameter $D_4$ of the clearance hole 86 to allow the ferrule 58 to slide in the receptacle 70 up to the maximum translations of plus or minus $C_c$ and $C_r$. The diameter $D_4$ of the clearance hole 86 is also less than the diameter $D_1$ of the ferrule 60 (i.e. base perimeter first and second edges 68*a* and 68*b*) so that the ferrule 58 is axially retained in the receptacle 70 once the retaining plate 74 is fixedly joined to the support plate 50.

In the preferred embodiment, the ferrule base aft surface 64 is preferably flat and the support plate forward surface 54 is also flat so the aft surface 64 may be positioned in sealing contact With the forward surface 54 during operation. During operation, the compressed airflow 44 generates a pressure force against the ferrule base 60 pressing the base 60 against the support plate forward surface 54 which provides a seal to ensure that the compressed airflow 44 is provided through the swirler 38 in precise, predetermined fashion as is conventionally known.

Accordingly, the fuel injector nozzle support 40 described above provides a relatively simple means for allowing differential thermal movement between the fuel injector nozzle 32 and the dome 24 while restraining rotation of the ferrule 58 without the use of conventional lugs and stops. The support 40 is relatively simple and may be relatively easily manufactured, by investment casting for example and provides for an increased useful life of the support 40. As long as the base perimeter 68 remains noncircular and has a diameter ($D_1$) which is larger than the minimum width $W_2$ of the receptacle 70, the ferrule 58 will always be prevented from rotating without restraint.

Although in one embodiment, the support plate 50 may be directly fixedly joined to the dome 24, in the preferred embodiment, it forms a portion of the otherwise conventional counterrotational swirler 38, which thereby fixedly joins the support plate 50 to the dome 24.

More specifically, the support plate aft surface 56 as illustrated in FIG. 3, for example, includes a plurality of circumferentially spaced conventional primary swirler vanes 90 extending perpendicularly outwardly therefrom and coaxially about the centerline axis 48. An annular septum 92 includes a radially extending flange 94 having its upstream facing surface fixedly joined to the vanes 90, and also includes an axially extending primary venturi 96 disposed coaxially about the centerline axis 48, integral with the radial flange 94, and in flow communication with the support plate aperture 52 and the primary vanes 90 for receiving the fuel 36 from the nozzle 32 channeled through the aperture 52 and air 44 from the vanes 90.

A plurality of circumferentially spaced conventional secondary swirler vanes 98 extend perpendicularly outwardly from the aft surface of the septum radial flange 94 and in an aft direction, opposite to the primary vanes 90. The swirler 38 further includes an annular housing 100 including a radially extending flange 102 fixedly joined to the secondary vanes 98 and disposed coaxially about the centerline axis 48. The housing 100 also includes an axially extending secondary venturi 104 formed integrally with the radial flange 102 and disposed coaxially around the primary venturi 96, and extending partly downstream therefrom, for receiving the air 44 from the secondary vanes 98 and the air 44 and fuel 36 from the primary venturi 96.

The swirler 38 is conventionally fixedly joined to the combustor dome, for example, by being fixedly connected at the secondary venturi 104 to the baffle 42 which in turn is fixedly connected to the dome 24 through the dome inlet 28, all by brazing, for example.

Figure 8:
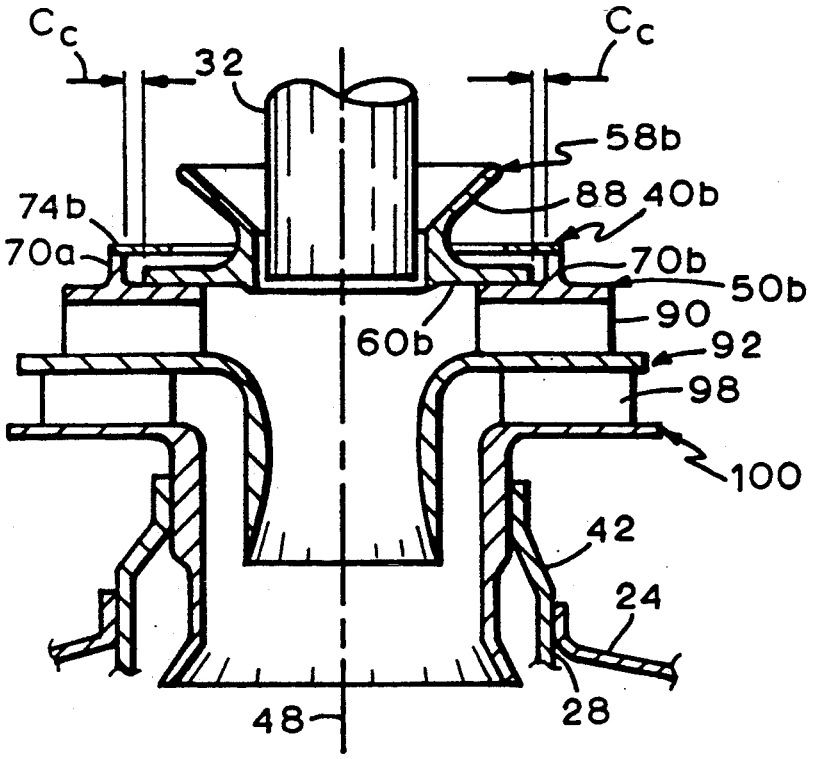
FIG. 8 is a radial sectional view of one of the identical carburetors illustrated in FIG. 6 taken along line 8—8 showing the second embodiment of the fuel injector nozzle support.
Figure 6:
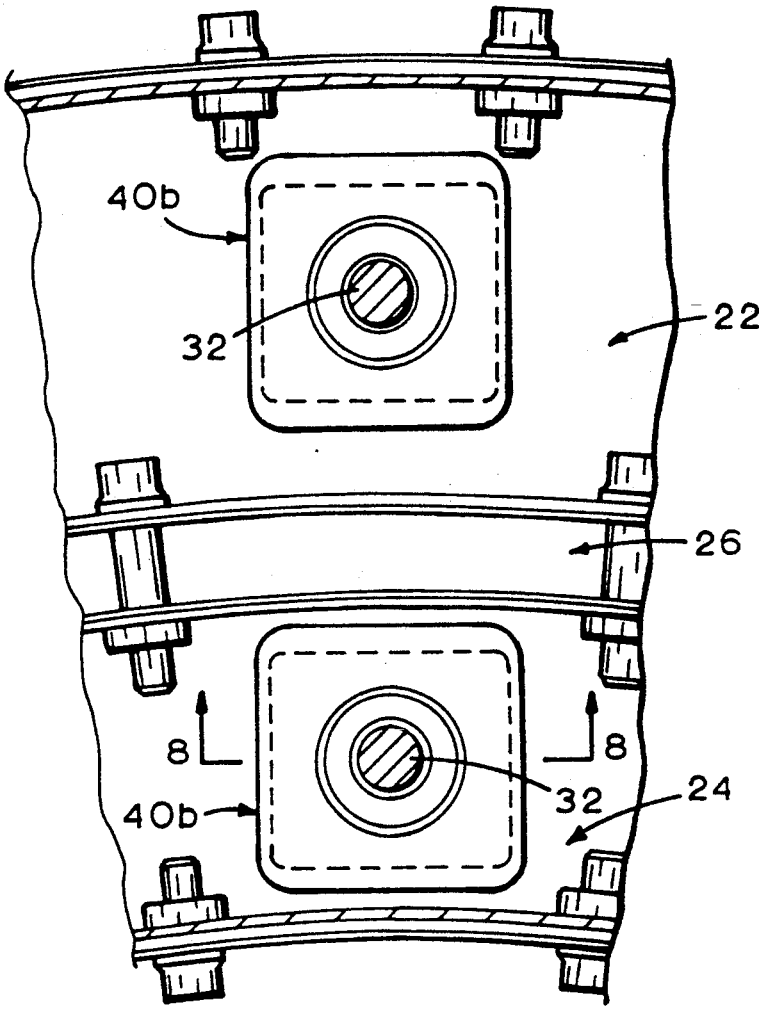
FIG. 6 is an aft facing, partly sectional view of a second embodiment of the fuel injector nozzle support illustrated in FIG. 1 also taken along line 2—2.
Figure 7:
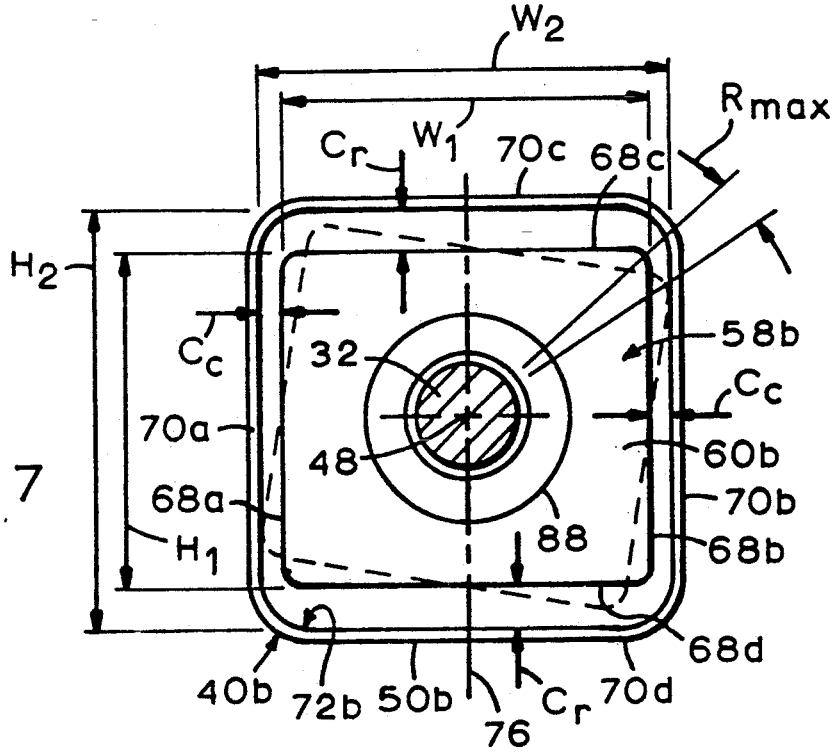
FIG. 7 is an enlarged, aft facing view of a portion of one of the identical fuel injector nozzle supports of the second embodiment illustrated in FIG. 6.

Illustrated in FIG. 6–8 is an alternate, second embodiment of the fuel injector nozzle support 40 which is designated 40*b*. The second nozzle support 40*b* is substantially identical to the first nozzle support 40 except for sizing as required for particular applications and by having a generally rectangular receptacle 70, rectangular base perimeter 68 of the ferrule 58*b*, and rectangular retaining plate 74*b* instead of the corresponding component in the first nozzle support 40 having the arcuate portions thereof.

As illustrated for example in FIG. 7, the ferrule base perimeter 68 is rectangular having four straight edges i.e. first and second edges 68*a* and 68*b* having a radial height $H_1$, and third and fourth edges 68*c* and 68*d* having a circumferential width $W_1$. Correspondingly, the support plate receptacle 70 is rectangular and has four straight flanges i.e. the first and second flanges 70*a* and 70*b* having a radial height of $H_2$ and the third and fourth flanges 70*c* and 70*d* having a circumferential width of $W_2$. In this embodiment, the receptacle inner circumference designated 72*b* is spaced both radially and circumferentially from the base perimeter 68 to define radial and circumferential clearances $C_r$ and $C_c$, respectively. The radial clearance $C_r$ allows the ferrule 58*b* to translate radially, either radially outwardly or radially inwardly to the predetermined maximum translation i.e. plus or minus $C_r$. The circumferential clearance $C_c$ allows the ferrule 58*b* to rotate counterclockwise or clockwise about the centerline axis 48 up to the predetermined maximum rotation $R_{max}$ i.e. plus or minus $R_{max}$.

In one embodiment, the ferrule base 60*b* and the support plate 50*b* are predeterminedly longer in the radial direction than in the circumferential direction such that $H_1$ is greater than $W_1$ and $H_2$ is greater than $W_2$ to define rectangles. In an alternate embodiment, the ferrule base 60*b* and the support plate 50*b* are equal in length in the radial and circumferential directions so that $H_1$ equals $W_1$ and $H_2$equals $W_2$, and the ferrule base perimeter 68 and the support plate receptacle 70 are both square. Of course, a square is the special geometric embodiment of a rectangle, with the square being preferred for minimizing the areas of the respective components while providing effective relative translation thereof for accommodating differential radial thermal movement while restraining rotation of the ferrule 58*b* about the nozzle 32.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A support for mounting a fuel injector nozzle in flow communication with an inlet of a dome of a combustor of a gas turbine engine having a longitudinal centerline axis comprising:

a support plate joinable to said dome and having a plate aperture disposable in flow communication with said dome inlet;

a ferrule having a base including a ferrule bore for slidably receiving said fuel injector nozzle, said bore being disposed in flow communication with said plate aperture for allowing fuel from said injector nozzle to be injected through said dome inlet;

said ferrule base having a noncircular perimeter characterized by the absence of a projecting tab for preventing rotation of said ferrule, and said support plate including a receptacle for receiving said ferrule base, said receptacle having an inner circumference being complementary to said ferrule base perimeter for preventing rotation of said ferrule base greater than a predetermined maximum rotation while allowing radial translation of said ferrule base up to a predetermined maximum translation for accommodating differential thermal movement of said fuel injector nozzle and said support plate; and means fixedly attached to said support plate for retaining said ferrule in said support plate receptacle.

2. A fuel injector nozzle support according to claim 1 wherein said ferrule base perimeter is rectangular.

3. A fuel injector nozzle support according to claim 2 wherein said support plate receptacle is rectangular and said inner circumference is spaced both radially and circumferentially from said ferrule base perimeter to define radial and circumferential clearances, respectively.

4. A fuel injector nozzle support according to claim 3 wherein said ferrule base and support plate are longer in a radial direction than in a circumferential direction.

5. A fuel injector nozzle support according to claim 3 wherein said ferrule base perimeter is square and said support plate receptacle is square.

6. A fuel injector nozzle support according to claim 3 wherein said ferrule retaining means comprises a rectangular retaining plate fixedly joined to said support plate for slidably retaining said ferrule base in said support plate receptacle, and includes a clearance hole for receiving said nozzle and allowing unrestrained translation of said nozzle.

7. A fuel injector nozzle support according to claim 1 wherein said ferrule base perimeter is quadrilateral having straight first and second spaced apart edges disposed parallel to each other.

8. A fuel injector nozzle support according to claim 7 wherein said support plate includes straight first and second spaced apart flanges disposed parallel to each other to define said receptacle, and spaced from said ferrule base perimeter first and second edges, respectively.

9. A fuel injector nozzle support according to claim 8 wherein said ferrule base perimeter further includes an arcuate third edge joining first ends of said first and second edges, and an arcuate fourth edge joining second, opposite, ends of said first and second edges.

10. A fuel injector nozzle support according to claim 9 wherein said support plate further includes an arcuate third flange joining first ends of said first and second flanges, and an arcuate fourth flange joining second, opposite, ends of said first and second flanges; said first, second, third, and fourth flanges defining said receptacle.

11. A fuel injector nozzle support according to claim 10 wherein said ferrule first and second edges are spaced from said first and second flanges, respectively, to define circumferential clearances, and said ferrule third and fourth edges are spaced from said third and fourth flanges, respectively, to define radial clearances.

12. A fuel injector nozzle support according to claim 11 wherein said ferrule retaining means comprises a retaining plate fixedly joined to said first, second, third, and fourth flanges for slidably retaining said ferrule base in said support plate receptacle, and includes a clearance hole for receiving said nozzle and allowing unrestrained translation of said nozzle.

13. A fuel injector nozzle support according to claim 12 wherein said first, second, third, and fourth flanges extend perpendicularly outwardly from a flat, forward surface of said support plate facing in an upstream direction, and said ferrule base has a flat aft surface facing in a downstream direction disposable in sealing contact with said plate forward surface.

14. A fuel injector nozzle support according to claim 13 wherein said ferrule further includes a forward surface facing in said upstream direction and a conical pilot extending outwardly therefrom for guiding said nozzle into said ferrule bore.

15. A fuel injector nozzle support according to claim 14 wherein said support plate includes an aft surface facing in said downstream direction having a plurality of circumferentially spaced swirler vanes extending outwardly therefrom.

16. A fuel injector nozzle support according to claim 15 wherein said support plate includes an annular septum having a radially extending flange fixedly joined to said vanes, and an axially extending venturi disposed in flow communication with said support plate aperture and said vanes for receiving fuel from said nozzle channeled through said support plate aperture and air from said vanes.

17. A fuel injector nozzle support according to claim 16 wherein said vanes are primary vanes and said venturi is a primary venturi, and further including a plurality of circumferentially spaced secondary swirler vanes extending outwardly from said septum and oppositely to said primary vanes.

18. A fuel injector nozzle support according to claim 17 further including an annular housing having a radially extending flange fixedly joined to said primary vanes, and an axially extending secondary venturi disposed coaxially around said primary venturi for receiving air from said secondary vanes and said air and fuel from said primary venturi.

* * * * *